US005683077A

United States Patent [19]

Fink et al.

[11] Patent Number: 5,683,077

[45] Date of Patent: Nov. 4, 1997

[54] VISE HANDLE WITH TORQUE CONTROL

[76] Inventors: Paul David Fink, 13427 Christie Dr., Saratoga, Calif. 95070; Thomas Bruce Truesdell, 16200 Fisher Ave., Los Gatos, Calif. 95032

[21] Appl. No.: 644,837

[22] Filed: May 10, 1996

[51] Int. Cl.[6] ..... B25B 1/10

[52] U.S. Cl. ..... 269/244; 269/43; 269/329

[58] Field of Search ..... 269/194, 195, 269/240, 241, 242, 244, 329, 43; 81/473, 474, 475, 476, 477

[56] References Cited

U.S. PATENT DOCUMENTS

| | | | |
|---|---|---|---|
| 3,208,316 | 9/1965 | Scribner | 81/476 |
| 3,442,360 | 5/1969 | Fulop | 81/475 |
| 3,650,522 | 3/1972 | Wermuth et al. | 269/244 |
| 3,779,538 | 12/1973 | Rohm | 269/27 |
| 3,807,721 | 4/1974 | Arnold | 269/228 |
| 3,815,889 | 6/1974 | Weber | 269/221 |
| 3,829,077 | 8/1974 | Strybel | 269/246 |
| 4,046,364 | 9/1977 | Coope | 269/244 |
| 4,098,500 | 7/1978 | Leuz | 269/136 |
| 4,738,438 | 4/1988 | Morie | 269/136 |
| 4,995,599 | 2/1991 | Pfluger | 269/27 |
| 5,192,062 | 3/1993 | Berchtold | 269/244 |

*Primary Examiner*—Robert C. Watson
*Assistant Examiner*—Thomas W. Lynch

[57] ABSTRACT

A handle for a machinists vise configured to preset the maximum clamping force that can be applied to the vise jaws constructed such that, in tightening the vise, when a clamping force is applied by the operator to the handle equal to a preset value, a clutching mechanism in the handle will allow the handle to slip without further tightening of the vise. The mechanism includes a ratchet for positive engagement in loosening the vise and for providing a clicking sound that the clutch is slipping and thereby alert the operator that maximum clamping force is being applied.

8 Claims, 2 Drawing Sheets

VISE HANDLE WITH TORQUE CONTROL

FIELD OF THE INVENTION

This invention relates to handles or machinist's vises known in the art as "speed" handles and particularly to a "speed" handle in which the maximum torque that can be applied to the handle is limited to a preset value so as to limit the clamping force applied by the jaws of the vise to the pan being clamped.

PRIOR ART AND BACKGROUND OF THE INVENTION

The machinist's vise is a well known device in the machining an for holding a part being machined on the table of a mill as the milling cutter machines the part. The typical machinist's vise is bolted onto the table surface of the mill and has a horizontal screw abutting a jaw of the vise and another end on which a handle is mounted and turned such as to clamp the jaws of the vise on the pan. The pan must be held very firmly to prevent slippage in the vise which could result in ruining the pan. However, in numerous instances, particularly when the pan has a thin section, the clamping force of the vise can at least temporarily deform the pan resulting in a necessity to make adjustments in machining the part to maintain tolerance. The problem is that variations in clamping force from one part to the next can result in variations of the machining dimensions which are greater than the machining tolerance. These variations in clamping force arise from differences between force applied by different operators or even with one operator such as would be due to fatique factors.

A number of modifications of the machinist's vise have been disclosed related to speed opening and closing the vise and applying controlled clamping force.

U.S. Pat. No. 5,192,062 to Berchtold discloses a clamping force adjusting device for a clamping device such as a vise which requires a force multiplier attached to a clamping rod.

U.S. Pat. No. 4,738,438 to Horie et al discloses a machine vise with a strain gage detector device enabling the operator to control applied clamping force.

U.S. Pat. No. 4,046,364 discloses a torque limiting device having a handle portion coupled to the drive screw of the vise through a friction clutch constructed as an integral part of the vise in which frictional force between the clutch disks can be preadjusted to permit slip when the torque applied to the handle portion exceeds a preset value. The handle is also coupled to the drive screw of the vise by a shrag clutch which is disengaged when the handle is turned in the direction to tighten the vise and is disengaged in the opposite direction so as to provide a positive coupling to retract (loosen) the vise jaws. The construction of Coope invention requires application of a spanner wrench to adjust the frictional limiting force of the clutch mechanism and th adjustment of the frictional limit force of the clutch mechanism is integral to the base of the vise.

There are several advantages for the present invention compared to the cited disclosures which are discussed further in the SUMMARY and DESCRIPTION to follow.

OBJECTS OF THE INVENTION

It is an object of this invention to provide a handle attachable to the drive screw of the standard machinist's vise for use in turning the drive screw to apply a preset clamping force on a part.

It is another object that this handle may be used with the typical (off the shelf) machinist's vise.

It is another object that the handle elicit a signal to the operator that slipping of the handle is occurring when the force applied to the handle reaches a preset value.

It is another object that the operator can preset a value of force with more convenience than is evidenced in the cited disclosures.

It is another object that the maximum force applied to the handle of the vise be more closely controlled than the devices of the prior art.

It is another object that the invention have a simpler construction and be more economical to build than the cited disclosures.

DESCRIPTION OF BEST MODES

Figure 1:
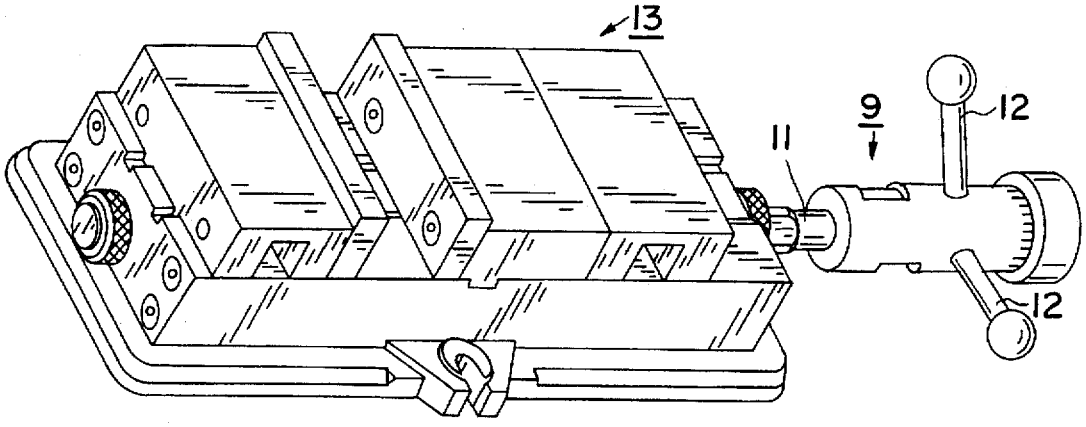
FIG. 1 shows a perspective view of the invention mounted on a machinist's vise.

Turning now to a discussion of the drawings, FIG. 1 is an assembly view of the "speed" handle 9 of the invention engaged on the drive shaft 11 of a machinist's vise 13.

Figure 2:
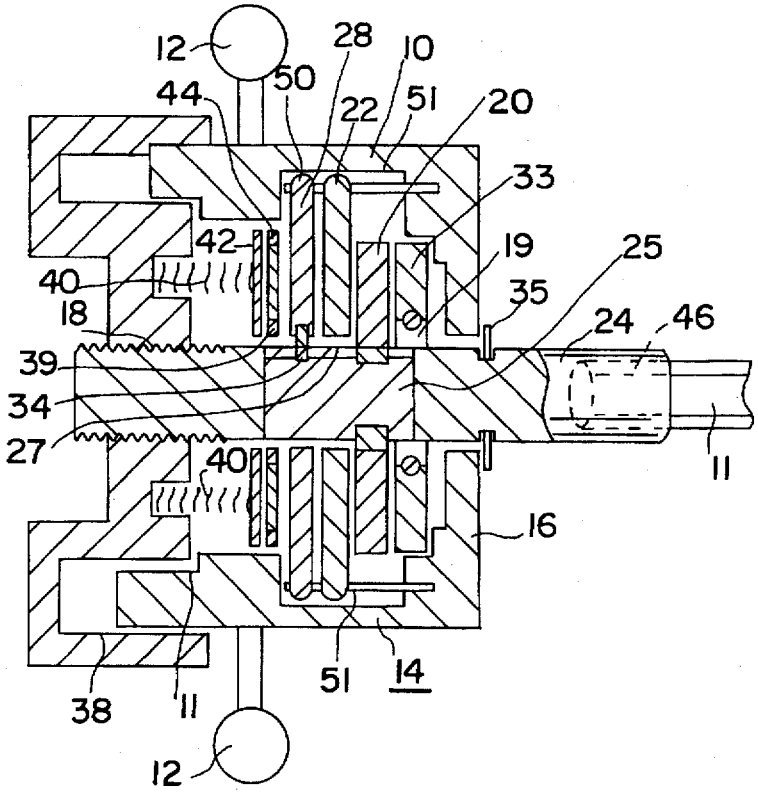
FIG. 2 shows a sectional view of one embodiment.

FIG. 2 is a sectional view of one embodiment of the invention showing a main body housing 10 with radial handles 12 extending from the housing 10. Housing 10 comprises a cylinder 14 with an end plate 16 formed on one end and an interior shoulder 11 on the other end.

Figure 3:
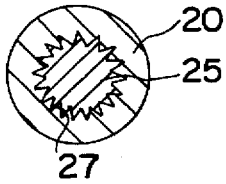
FIG. 3 shows a sectional view of the clutch disk.

A drive shaft 24 extends through an opening in the wall of the housing 10. The drive shaft 24 is retained in its position by a rotary bearing 33 seated in the interior side of the housing wall with the inner race of the rotary beating 33 pressed onto the drive shaft 24 and a snap ring 35 snapped into a groove on the drive shaft 24 on the outside of the housing wall. The drive shaft 24 has a section 25 with axial ratchet teeth 26 as illustrated by the sectional view in FIG. 3.

A clutch plate 20 abutting a friction disk 22 is mounted on drive shaft 24 and has an interior bore with a ratchet surface 27 that mates with the ratchet teeth 26 of drive shaft 24. Therefore, clutch plate 20 turns with drive shaft 24 but can slide axially on drive shaft 24.

Figure 4:
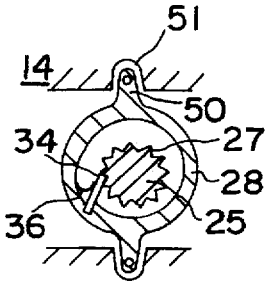
FIG. 4 shows a sectional view of the ratchet disk.

FIG. 2 and sectional view FIG. 4 show a ratchet disk 28 having a ratchet 34 arranged to engage any one ratchet tooth 26. Ratchet 34 is biased by spring 36 so as to prevent drive shaft 24 from turning in a counterclockwise direction with respect to ratchet disk 28 but permit the drive shaft 24 to turn in the clockwise direction with respect to ratchet disk 28. Ratchet disk 28 has a set of lobes 50 that engage interior axial grooves 51 in the interior surface of the housing cylinder 14 so that ratchet disk 28 is constrained to turn with housing 10 but is free to slide axially. The ratchet 34 is biased by spring 36 into successive contact with ratchet teeth 26 as the drive shaft 24 turns clockwise and is lockingly engaged with one of ratchet teeth 26 when drive shaft 24 is mined counter clockwise.

A cap 38 is screwed onto a threaded end 18 of drive shaft 24 and carries a plurality (two are shown in FIG. 2) of helical springs 40 extending axially from the cap 38. A thrust plate 42 is rotatably mounted on drive shaft 24 with a thrust bearing plate 44 interposed between thrust plate 42 and ratchet plate 28. Springs 40 force thrust plate 42 against rotary bearing 39, and thrust bearing 44 so that the force of springs 40 is transmitted against ratchet plate 28. Ratchet disk 28 is thereby forced against friction surface of friction disk 22 with a "friction" force that is adjustable by screwing cap 38. left or right on thread 18. Drive shaft 24 has a bore 46 having a shape (typically a square) for receivingly engaging the drive shaft 11 of a vise.

Figure 6:
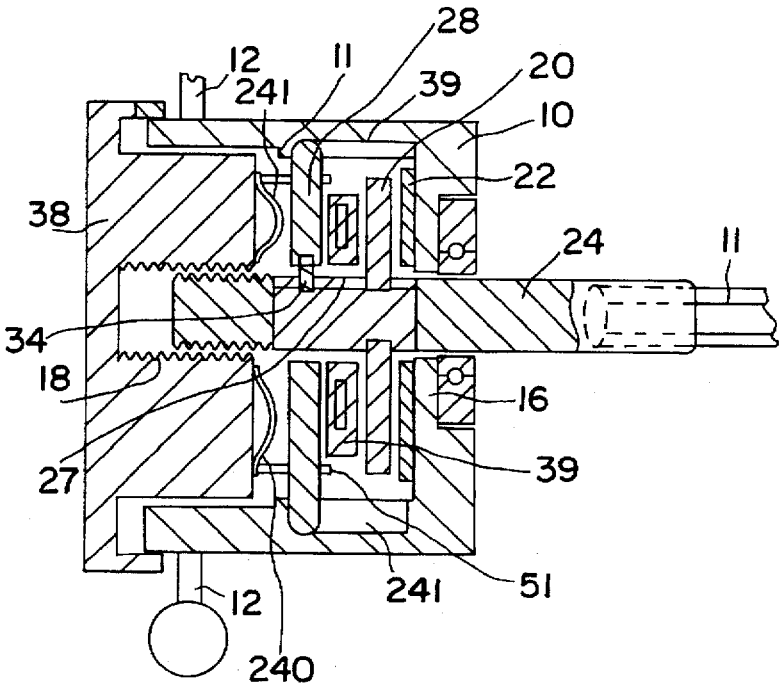
FIG. 6 shows a section view of a third embodiment

FIG. 6 is another embodiment of the invention which functions similarly to the embodiment of FIG. 2 except that the fiction disk 22 is firmly secured to the end cover 16 of the housing 10 and the clutch disk 20 is positioned between the thrust bearing 39 and the fiction disk 22.

FIG. 6 also shows the use of Bellvue springs 240 in place of the helical springs of the other embodiments.

Figure 5:
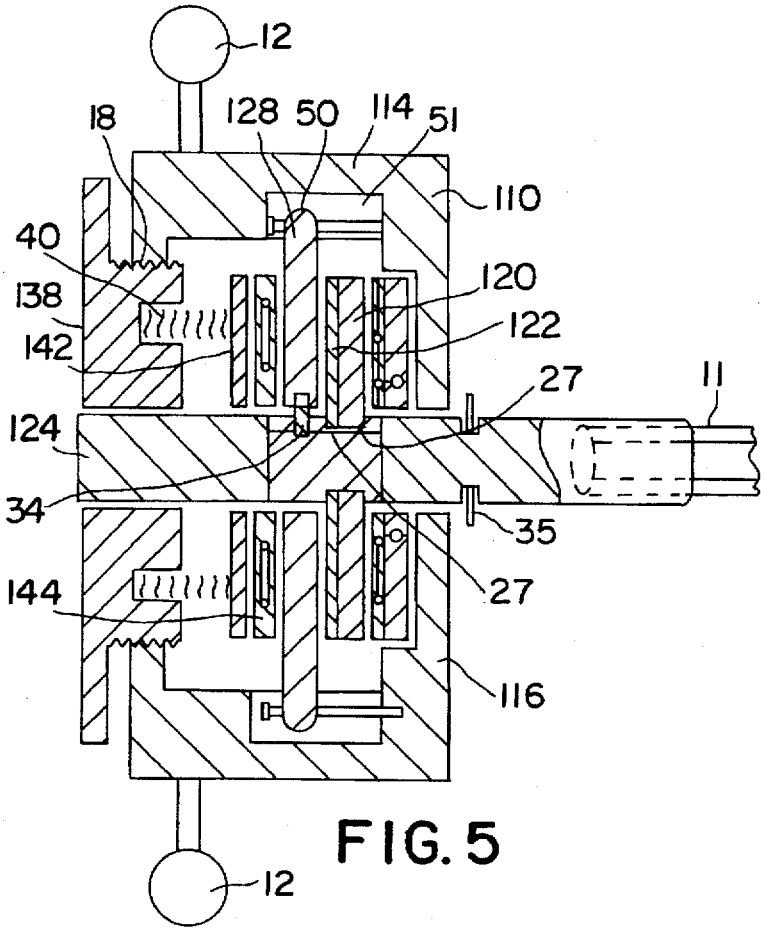
FIG. 5 shows a section view of a second embodiment.

FIG. 5 is a sectional view of another embodiment of the invention showing a main body housing 10 with radial handles 12 extending from the housing 10. Housing 110 comprises a cylinder 14 with an end cover 16 on one end and an interior thread 18 on the inside surface at the other end.

A drive shaft 124 extends through an opening in the end cover 116 into the housing 110. The drive shaft 124 has a section 25 with axial ratchet teeth 26 as illustrated by the sectional view in FIG. 3.

A fiction plate 120 having a fiction surface 122 is mounted on drive shaft 124 and has an interior bore with a ratchet surface that mates with the ratchet teeth 26 of drive shaft 124. Therefore, fiction plate 120 turns with drive shaft 24 but will slide axially on drive shaft 124.

A ratchet disk 128 is rotatably mounted on drive shaft 124 and has a ratchet 34 arranged to engage any one ratchet tooth 26 and prevent drive shaft 124 from turning in a counterclockwise direction but permit the drive shaft 124 to turn in the clockwise direction. Ratchet disk 128 has a set of lobes 50 that engage interior axial grooves 51 in the interior surface of the housing cylinder 114 so that ratchet disk 128 will turn with housing 110 but is free to slide axially. The ratchet 34 is biased by spring 36 shown in FIG. 4 into successive contact with ratchet teeth 26 as the drive shaft 124 turns clockwise which occurs when the drive shaft 124 is prevented from further turning by engagement of the part in the vise even though the operator continues to turn the handle 12 attached to the housing 10.

A cap 138 is screwed into interior thread 18 of housing 110 and carries a plurality of helical springs 40 extending axially from the cap 138. A thrust disk 142 is rotatably mounted on drive shaft 124 with a thrust bearing 144 interposed between thrust disk 142 and ratchet disk 128. Springs 40 force thrust disk 142 against thrust bearing 44 so that the force of springs 40 is transmitted against ratchet plate 28. Ratchet plate 28 is thereby forced against friction surface 22 with a "friction" force that is adjustable by screwing cap 38 into or out of housing 10 on interior thread 18. As shown in sectional view FIG. 4, drive shaft 24 has a bore 46 having a shape (typically a square) for receivingly engaging the handle of a vise (not shown).

In use of either the embodiments of FIGS. 1, 5 or 6, the vise handle of this invention is positioned with the "handle" drive shaft 24 receivingly engaging the drive screw of the vise. FIGS. 1,5 and 6 show a cutaway view of the typical drive screw 11 of a vise (vise not shown) inserted into the drive shaft 24, 124, 24 respectively of this invention. When the radial handles 12 are rotated clockwise, the housing cylinder 14, along with cap 38 with springs 40 against thrust bearing 42 and ratchet plate 28 all rotate.

In the embodiment of FIG. 2, when drive shaft 24 is free to turn, the force exerted by springs 40 force ratchet plate 28 and friction disk 22 against the clutch disk 20 so that when the handles 12 are turned, the ratchet disk 28, friction disk 22, clutch disk 20, and drive shaft 24 all turn. When the drive shaft 24 can no longer turn because the preset clamping force is reached, contact between friction disk 22 and clutch disk 20 will slip and the ratchet 34 will "click" over the ratchet teeth 27 as the handle is turned. The embodiment of FIG. 6 functions similarly to the embodiment of FIG. 2 because the friction disk is firmly secured against the end cover of housing 10 and therefore must rotate with housing 10.

When handles 12 are turned in the opposite direction, ratchet 34 will engage one of ratchet teeth.

In the embodiment of FIG. 5, when drive shaft 124 is free to turn, friction disk 120 will also turn because of its friction contact with ratchet disk 128 and thereby turn clutch plate 120 engaged with drive shaft 124. When drive shaft 124 is no longer free to turn (due to clamping of the vise) clutch disk 120 will no longer turn thus overcoming the friction force exerted by the ratchet disk 128 against the friction disk 122. Therefore, the ratchet disk 128 will rotatably slip on the friction disk 122 as the operator continues to turn the handle 12. The value of friction force, (called herein the "critical force") and therefore the force between the vise jaws, is determined by the force of the springs 140 transmited to the ratchet disk 128. The operator presets the critical force by rotatably adjusting the cap 138 on the thread 118 of drive shaft 124.

After reaching the critical force continued turning of the handle 12 will cause the ratchet 34 to snap past the interior ratchet tooth of the ratchet section of ratchet disk 28. This snapping action produces an audible click which the operator hears alerting him that he has clamped up to the preset force for the vise jaws.

In each of the embodiments, when the operator is required to loosen the vise jaws, he rotates the handles 12 to rotate housing in the counterclockwise (opposite) direction such that ratchet 34 engages a ratchet tooth of the ratchet surface thereby causing the drive shaft to turn and loosen the vise.

As shown in the assembly view of FIG. 1, indicia 55 placed on the housing to indicate the position of the cap may be used to calibrate the preset force which is the upper limit of force applied to the clutch plate before slipping.

As shown in FIG. 1, the outside of the housing has flats 9 such that a torque wrench (wrench not shown) can be applied to the housing for calibrating the setting of the cap vs. clamping force. Torque wrenches are well known in the art.

An important feature of this invention compared to the devices of the prior art is that the operator receives a positive signal, i.e., the crick heard and/or felt by the operator when the force applied to turn the handle 12 reaches the preset force and the ratchet clicks on each tooth of the ratchet surface of the drive shaft as the operator continues to turn the handle. This feature substantially reduces cycle time required by the operator because he is alerted immediately when the clamping force has reached the preset value and he does not have to "experiment" (by turning the handle excessively) to be assured that he has reached the preset clamping force.

Another advantage compared to, say, the Coope disclosure is that the ratchet disk, used to apply the unclamping force and the signal to the operator, is also a part of the friction clutch plates that transmit the force applied by the handles to the drive shaft. This arrangement considerably reduces cost and simplifies construction of the present invention.

Another advantage of the present invention is that the construction wherein the ratchet engages ratchet teeth without slip is inherently less prone to wear than for example, the shrag clutch disclosed in Coope.

Variations and modifications of the invention may be suggested by reading the specification and studying the drawings which are within the scope of the invention.

For example, the multiplicity of springs described above may be replaced by a different spring arrangement such as a single larger spring between the end of the cap and the thrust bearing and around and concentric with the drive shaft.

Although springs 40 are shown as helical springs, alternatively the springs may be "bellvue" springs.

In view of these modifications which are within the scope of the invention, I therefore wish to define my claims by the appended claims.

What is claimed is:

1. A handle for detachable engagement on the vise shaft of a vise for controlling the maximum clamping force of the vise which comprises:

a drive shaft having a bore on one end adapted to mate with said vise shaft of said vise;

said drive shaft having a section with ratchet teeth on a surface of said section;

a ratchet disk means rotatably and slidably mounted on said drive shaft and having a ratchet means for coupling said ratchet disk means to said drive shaft when said ratchet disk means is turned in a first direction and decoupling said ratchet disk means from said drive shaft when said ratchet disk means is turned in an opposite direction;

a housing with a first opening;

means for rotatably mounting and retaining said drive shaft in said housing with said one end of said drive shaft extending through said first opening;

handle means attached to said housing means for turning said housing;

means for constraining said ratchet disk means to turn with said housing means when said housing means is rotated;

a clutch disk mounted on said drive shaft to turn with said drive shaft;

means for constraining said clutch disk to rotate with said drive shaft when said drive shaft is rotated;

a friction disk mounted on said drive shaft between said clutch disk and said ratchet disk means;

means for constraining said friction disk to rotate with one of:

(i) said clutch disk or;

(ii) said housing;

means for setting a preset value of force;

a cap means mounted onto a second end of said housing;

a spring means interposed between an end of said cap means facing said ratchet disk means whereby said spring means forces said ratchet disk means against said friction disk and said friction disk is forced against said clutch disk.

2. The handle of claim 1 wherein said fiction disk is constrained to rotate with said clutch disk and said means for setting said preset force comprises:

said second end of said housing being a threaded end;

said cap means being screwed into said end of said housing and operably arranged such that said spring means forces said ratchet disk means against said friction disk with a force that is preset by positioning said cap means on said threaded end of said housing.

3. The handle of claim 1 wherein said friction disk is constrained to rotate with said housing and said means for setting said preset force comprises:

another end of said drive shaft being a threaded end:

said cap means being screwed onto said another end of said drive shaft and operably arranged such that said spring means forces said ratchet disk means against said clutch disk with a force that is preset by positioning said cap means on said threaded end of said drive shaft.

4. The handle of claim 1 which further comprises indicia on said housing and said cap means for calibrating the preset force.

5. The handle of claim 1 wherein said housing has an outer shape adapted to receive a torque measuring wrench for determining a value of said preset force corresponding to indicia on said housing and said cap means.

6. The handle of claim 1 wherein said means for rotatably mounting removably comprises:

a rotary bearing having an inner race pressed on said drive shaft and an outer race seated in a wall of said housing;

a snap ring positioned in a circumferential groove of said drive shaft such that said drive shaft extending through a wall of said housing is retained by said rotary bearing on one side of said wall and by said snap ring on an opposite side of said wall.

7. A method for clamping a part in a vise with clamping force that does not exceed a preset clamping force which includes in operable order the steps of:

(a) providing the vise handle of claim 1;

(b) mounting said vise handle on the drive shaft of said vise;

(c) setting a means for presetting clamping force of said vise such that clamping pressure applied to the part by turning a means for turning said vise handle will not exceed said preset clamping force;

(d) turning said means for turning with a clamping force sufficient to clamp said vise on said part and cause said ratchet disk means to slip on said handle drive shaft.

8. The handle of claim 1 which comprises:

a thrust bearing mounted on said drive shaft between said ratchet disk means and said clutch disk;

a friction disk rotatably concentric with said drive shaft and attached to a wall of said housing such that said friction disk is constrained to rotate with said housing;

a spring means interposed between an end of said cap means facing said ratchet disk means whereby said spring means forces said ratchet disk means against said thrust bearing and said clutch disk on one side of said clutch disk and another side of said clutch disk is forced against said friction disk.

* * * * *